United States Patent [19]

Minnetti

[11] 4,281,959

[45] Aug. 4, 1981

[54] HANK TRANSFER APPARATUS

[75] Inventor: Federico Minnetti, Pieve a Nievole, Italy

[73] Assignee: Officine Minnetti di Ornella Raveggi & C. S.A.S., Pieve a Nievole, Italy

[21] Appl. No.: 57,802

[22] Filed: Jul. 16, 1979

[30] Foreign Application Priority Data

May 10, 1979 [IT] Italy ..... 22531 A/79

[51] Int. Cl.[3] ..... B65G 47/36

[52] U.S. Cl. ..... 414/668; 28/287; 198/651; 414/564; 414/590; 414/672

[58] Field of Search ..... 414/564, 589–591, 414/643, 662–666, 668–670, 672; 198/651; 28/287, 288; 8/155.2

[56] References Cited

U.S. PATENT DOCUMENTS

| | | | |
|---|---|---|---|
| 2,431,618 | 11/1947 | Rayburn et al. | 414/564 |
| 3,223,267 | 12/1965 | Stammen | 414/671 |
| 3,541,635 | 11/1970 | Crenshaw | 8/155.2 |

FOREIGN PATENT DOCUMENTS

| | | |
|---|---|---|
| 722149 | 12/1931 | France . |
| 2057687 | 4/1971 | France . |
| 383909 | 1/1965 | Switzerland . |
| 366787 | 2/1932 | United Kingdom . |

*Primary Examiner*—Robert G. Sheridan

*Attorney, Agent, or Firm*—Fleit & Jacobson

[57] ABSTRACT

A hank transfer apparatus for transferring hanks from a hank carrier (100) to a holding or transporting device, comprises, on a stationary structure (11, 12, 13) a movable head (72) carrying two parallel hank-holder rods (90, 91) extended therefrom, which can be moved near each other in a closing position for introduction into a hank hanging from a hank carrier, and moved away from each other to an opening position for removing a hank from its own hank-carrier; the head (72) is movable in three orthogonal directions and rotatable, by sliding members (25, 40, 70) and guides (15,16; 31,32; 63,64) and a rotational device (50).

12 Claims, 9 Drawing Figures

HANK TRANSFER APPARATUS

This application relates to an apparatus for skein or hank transfer from a hank holder or hank carrier to a holding or transporting device or the like; the apparatus comprises, on a movable head, a pair of extended rods movable between a closing/or approached position and a spread apart position.

In yarn process systems or plants, wherein the yarns are moved through the plant as wound up in hanks, the need arises at various locations in the plant to shift the hanks from one to another implement or fixture. Particularly, at the outlet from a hank-dryer which, for example, follows a dyeing station, it is required to seize the hanks coming out from the dryer which hanks are carried on hank-carriers, and arrange them on a carriage or conveyor belt or other conveyor means, for supply to further processings or directly to packing. This hank transfer from moving hank-carriers to another conveyor means is generally manually carried out, and accordingly has on one hand the disadvantage of a high cost, and on the other hand that of being a tedious and repetitive work.

Hank transfer has the further problem of avoiding tangles in the yarns, while maintaining a correct disposition for the hank as the latter is being handled.

Therefore it was proposed to mechanize said transfer operation and this for a reduction in the involved costs. This has been accomplished by the apparatus according to the present invention, which apparatus comprises on a fixed supporting structure a head capable of moving in three directions at right angles to one another, and of rotating said head carrying two parallel hank holding rods extending therefrom, which can be moved near each other in a closed position for introduction in a hank suspended to a hank carrier, and away from each other to an open position for removal of the hank from its hank carrier.

Particularly, according to an embodiment at present preferred, the apparatus of the present invention comprises fixed vertical sliding uprights on said stationary structure with a slider device moving therealong. This slider device is fast with a frame carrying first sliding guides extending transversely of said sliding uprights. A slide moves on said first sliding guides and through a driven rotatable device supports a frame carrying two further sliding guides or bars transversely of said sliding uprights. A carriage moves on the last mentioned sliding bars and supports the hank holder rods and the opening and closing device therefor.

The movements for said slider, slide and carriage, as well as the movement for said rotatable or rotational device can be controlled, as desired, by mechanical or hydraulic devices.

Thus, the inventive apparatus allows to avoid labour in the sequence of operations required for unloading and transfer of hanks and affords a smooth quick transfer operation.

An at present preferred embodiment of the invention will now be described by way of unrestrictive example with reference to the accompanying drawings, in which.

Figure 1:
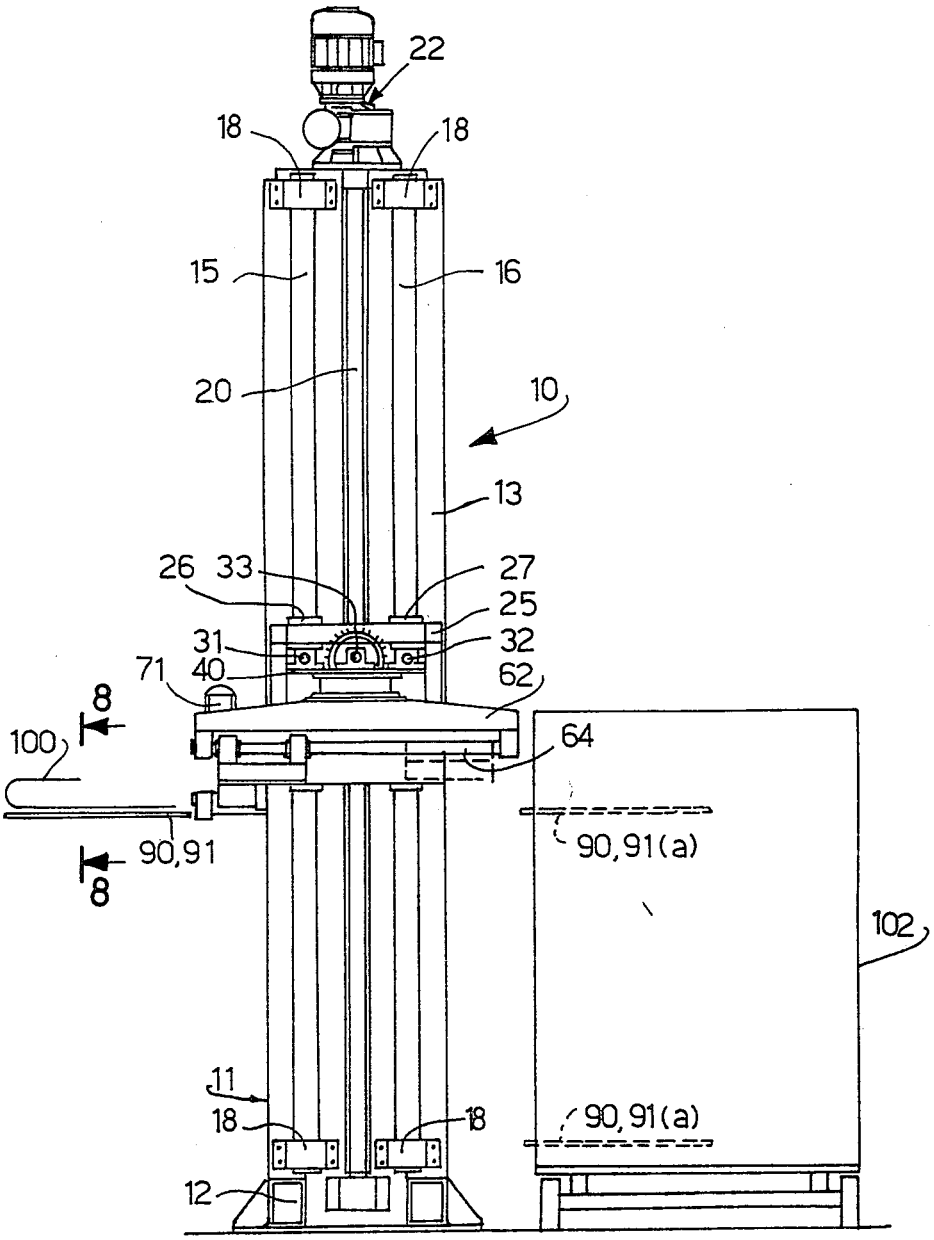
FIG. 1 is a front view of the apparatus as a whole.
Figure 8A:
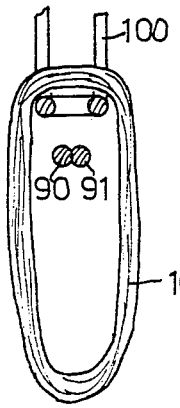
Figure 8B:
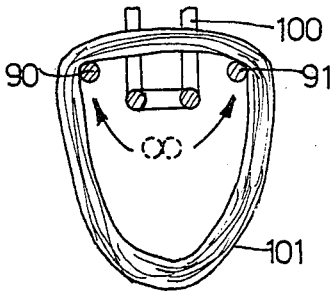

FIGS. 8*a* and 8*b* are sectional views taken along line 8—8 of FIG. 1, showing a portion of the apparatus at different operating steps.

The skein or hank transfer apparatus according to the present invention will now be described particularly with reference to the application to a hank processing plant, and more particularly it has been designed for transferring hanks coming out of a hank-dryer to a transport means; while it should be understood that it could be as well applied also at other locations of a hank processing plant, or in different plants, it being understood that it should be covered also for these and other possible applications.

The transfer apparatus 10 of this invention substantially comprises a supporting structure 11 which, in the case as shown in the figures of the accompanying drawings, is formed of a base frame 12 made of metal sections and a vertical pillar 13. This vertical pillar 13 has secured thereto two sliding guides which, in this exemplary embodiment, comprise two vertical uprights 15 and 16, respectively, attached for example by brackets 18 at the ends. Intermediate of uprights 15 and 16, there is a first vertical and rotatable threaded stem 20, which is rotatably driven by a geared motor unit 22, which is mounted on a top platform 23 of the supporting structure 11. A slider device 25 is slidably mounted on said sliding uprights 15 and 16 by means of two pairs of sleeves, one pair on each upright; the sleeves for upright 15 being indicated at 26, 26 and for those for upright 16 at 27, 27. The sleeves may be of any known form, for instance they will comprise brackets with sliding bearings. The slider device 25 further comprises a nut screw (not shown in the drawings) meshing on the threaded stem or screw 20 for controlling the slider movement along uprights 15 and 16. A frame 29 has a first end portion integral with the sleeves 26 and 27 and a cantilevered portion extending away from the sleeves. This frame 29 of the slider device 25 carries second sliding guides in the form of cylindrical bars 31 and 32 extending at right angles to the first sliding guides 15 and 16; and carries therebetween a second threaded stem 33 (which is shown only in FIG. 6) that is rotatably driven by a geared motor unit 34 (FIG. 2).

Figure 2:
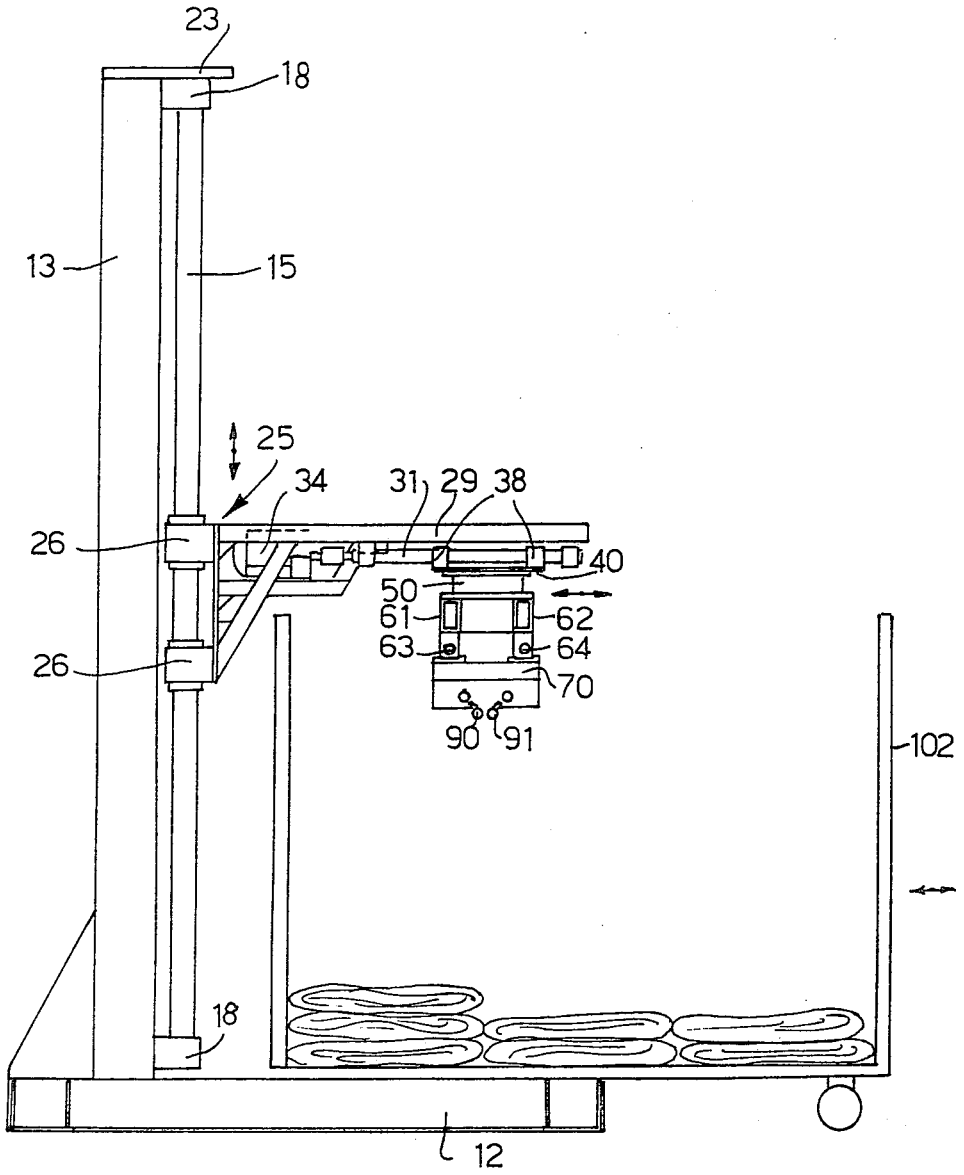
FIG. 2 is a side view as seen from the left of FIG. 1.
Figure 6:
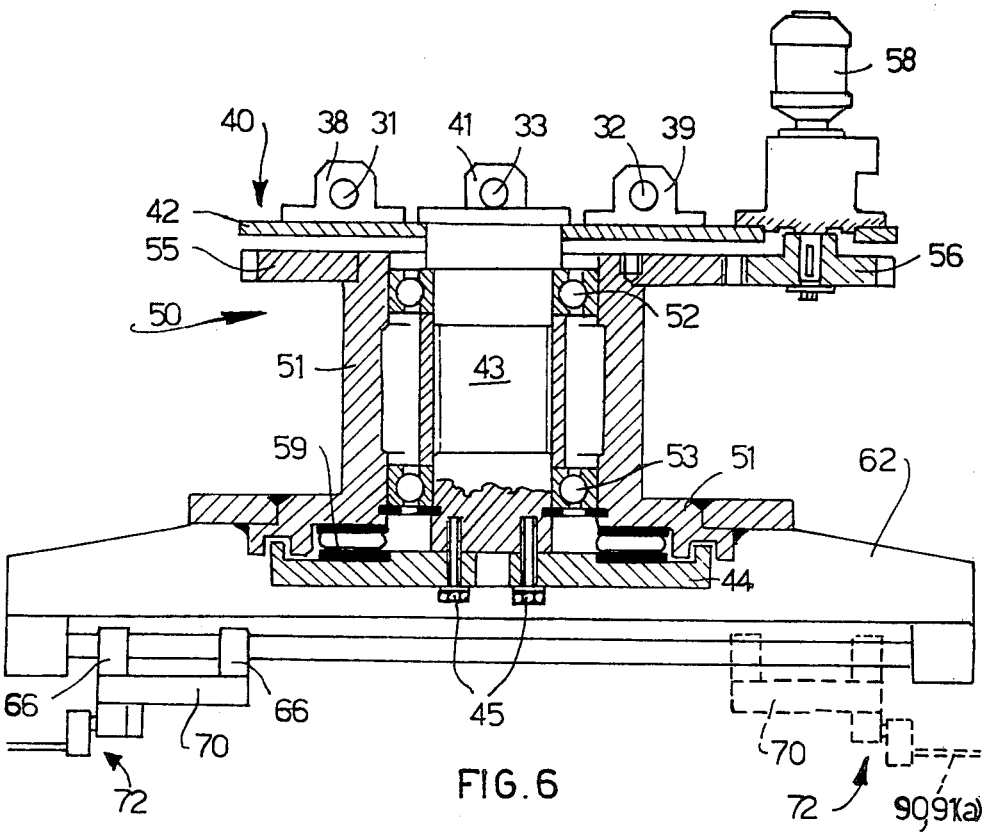
FIG. 6 is an enlarged axial sectional view of the rotational device.
Figure 7:
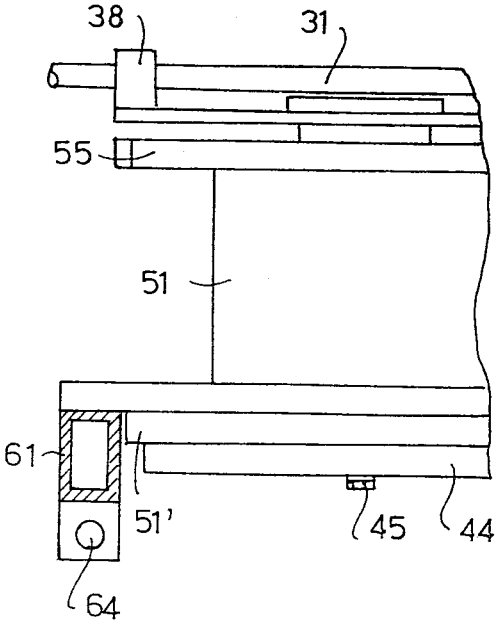
FIG. 7 is a fragmentary view as seen from the left of FIG. 6.

A slide assembly 40 on the cylindrical bars 31 and 32 is slidably carried by two pairs of sleeves or brackets with bearings (of which one pair 38, 38 is shown in FIG. 2, and another sleeve 39 is shown in FIG. 6). This assembly 40 is better shown in FIGS. 6 and 7 and is integral with a nut screw 41 meshing with threaded stem 33 for the slide movement along the guides 31 and 32. Said assembly or slide 40 comprises a top plate 42 integral with the sleeves 38 and 39 and threaded stem 33, and a pin 43 extending between said plate and having a bottom supporting plate 44 attached thereto, for example by screws 45. The rotational device 50 is mounted about said pin 43 and comprises a rotating body 51 mounted about pin 43 by two ball bearings 52 and 53. At the top end, the cylindrical body 51 carries a driven gear wheel 55 meshing with a driving pinion 56 which, in turn, is driven by a geared motor unit 58 mounted on plate 42.

At the bottom, said cylindrical body 51 widens out in a flange 51' and a roller thrust bearing 59 is interposed between said flange and said bottom plate 44.

Figure 3:
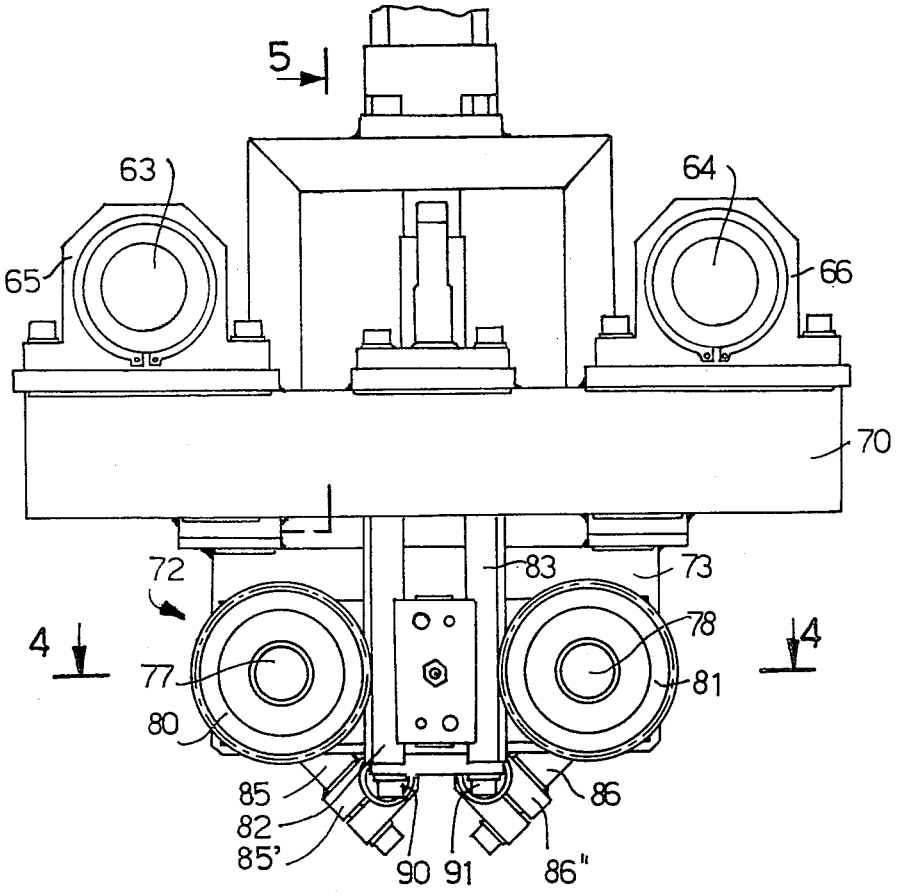
FIG. 3 is an enlarged view, as seen from the right of FIG. 1, showing the detail for the head carrying the openable hank-holder rods.
Figure 4:
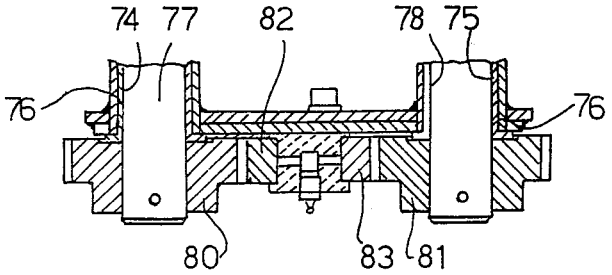
FIG. 4 is a cut away sectional view taken along line 4—4 of FIG. 3.
Figure 5:
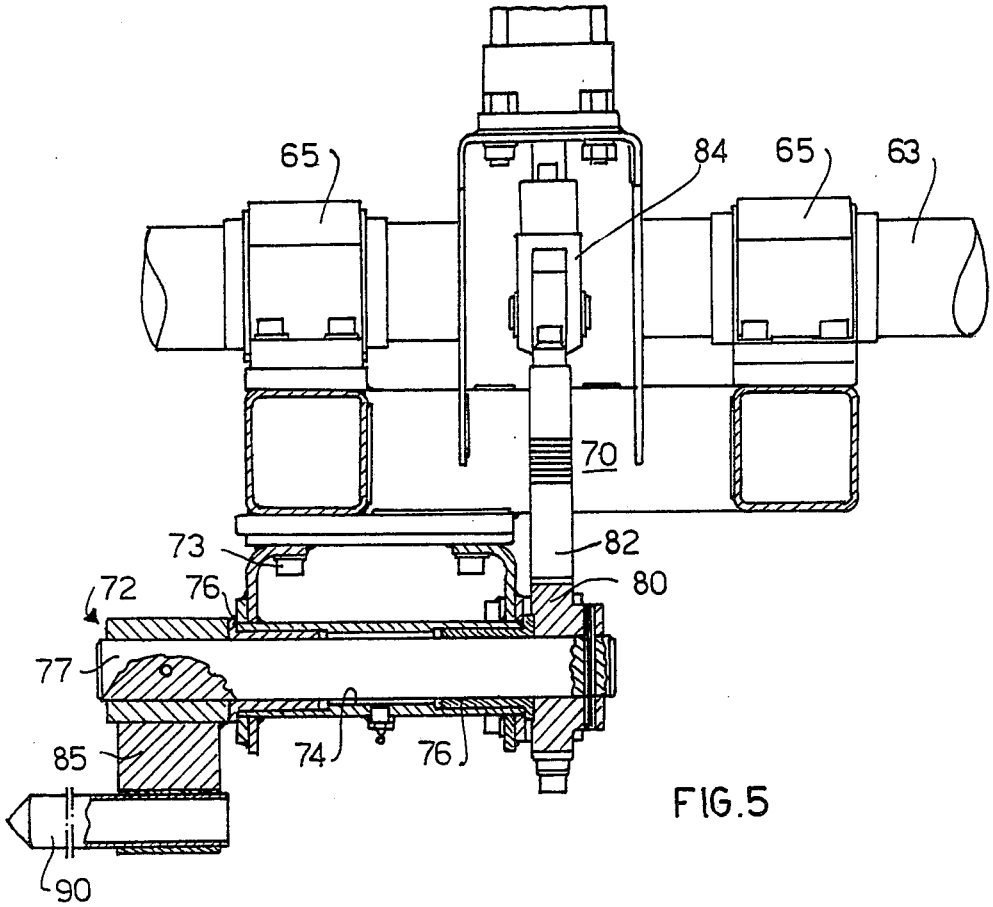
FIG. 5 is a sectional view taken along line 5—5 of FIG. 3.

A supporting framework comprising two parallel arms 61 and 62 is secured to said flange 51' of the rotating body. Each of the arms carry a sliding guide, generally in the form of a cylindrical bar, shown in the drawings at 63 and 64, respectively. A carriage 70 is slidably carried on bars 63 and 64 by means of sleeves 65 and 66 and associated brackets (FIG. 3) and in the particular embodiment shown comprises a quadrangular frame of sections. The sliding for carriage 70 is controlled by motor 71 (shown in FIG. 1). At the bottom, a rod holder head 72 is integral with carriage 70 and comprises a support or bearing 73 secured to carriage 70 and having two parallel cylindrical passages 74 and 75 to accomodate by bearings (generally bushings) 76 (see FIGS. 4 and 5) respective parallel rotatable spindles 77 and 78.

Each of spindles 77 and 78 carry at one corresponding end a gear wheel 80 and 81, respectively, suitably secured, such as by pins. Each of the gear wheels mesh with a respective rack 82 and 83, the two racks being driven together through a fork 84 by a driving means, not shown in the drawings.

At the opposite end respectively to the gear wheel, each of the spindles 77 and 78 carry integrally therewith a supporting element 85 and 86, respectively, and each of the supporting elements carry by means of brackets 85' and 86' a rod indicated at 90 and 91, respectively. Cantilevered rods 90 and 91 extend from the respective supporting elements and are parallel to each other. It will be also noted that, due to the particular assembly of the carrying elements, as above described, said rods 90 and 91 may be moved to or away (spread apart) from each other, while being always parallel to each other. Preferably, the adjustment between the racks and associated gear wheels is such that the rods are always in a horizontal plane.

Thus, from the foregoing it will be understood that the rod carrying head is rectilinearly movable along three directions, of which two directions are at right angles to each other, while the third direction is perpendicular to the first direction, and can be also rotated through a desired angle about an axis parallel with the first direction of translation.

It should also be noted that the rotational device may be placed at other locations of the machine.

The operation of the machine will now be explained with reference to hank transfer from hank-carriers movable on an endless chain to trucks or conveyor belts. A widely used hank-carrier is shown at 100 of FIG. 1 and is somewhat hook shaped with a lower portion substantially planarly extending formed by two parallel small bars. Each of the carriers has one or more hanks hanging therefrom and each of the carriers are generally hooked or coupled to a chain or other moving means (not shown). When a hank-carrier 100 to be unloaded moves along the transfer apparatus 10, a movement of the carriage 70 along the bars 63 and 64 would introduce the rods 90 and 91, which are at the approached condition thereof of FIGS. 2 and 3, into the hank 101 under the extended lower length of the hank-carrier 100. The situation is now as shown in FIG. 8*a*. Therefore, both of the racks 82 and 83 are operated to open or spread apart said rods 90 and 91 to a mutual distance larger than the width of the extended lower length of the hank-carrier 100. This movement brings the rods 90 and 91 to a level slightly higher than the lower length of said carrier 100. Thus, the disposition of the hank is substantially as in the diagram of FIG. 8*b*, that is the hank is hanging from the spread apart rods 90 and 91. Therefore, a movement of the carriage 70 to the right in FIG. 1 can readily slip the hank 101 off from the hank-carrier 100. After slipping off or removal of hank 101, the rods 90 and 91 can be moved near each other. Then, the rotational device 50 is rotated, for example through an arc of 180°, so as to bring the rods to the hatched position shown at 90, 91 (*a*) in FIGS. 1 and 6. Then, the operation of the geared motor 22 for the vertical movement and geared motors 34 and 71 for the horizontal movement in two orthogonal directions enables to lower the rod assembly (for example, to the position 90, 91(*b*) of FIG. 1) so as to arrange the hank at a desired position on a conveyor carriage 102 or conveyor belt (not shown) or on any other means. The rods are then slipped off from the hanks and the apparatus can start a new operation.

As apparent, variations or modifications can be made to the foregoing description without departing from the field of the present application.

What is claimed is:

1. An apparatus for hank transfer from a hank-carrier to a holding or transporting device, said apparatus comprising a base (12, 13); a rod holding movable head (72) mounted for horizontal and vertical movement with respect to said base; a pair of extended rods (90, 91) on said head, which are substantially parallel to each other and movable with respect to said head between a closed approach position and a spread apart position; means for controlling the movement of said rods between said positions; and movement means for moving said head including means for moving said head in a direction substantially parallel with the direction in which said rods extend from said head, said rods in said closed approach position being positioned close to each other to minimize transverse dimensions of said rods.

2. An apparatus according to claim 1, wherein said means for controlling the movement of said rods comprise two spindles (77, 78); a rod support (85, 86) integral with each of said spindles; gear wheels (80, 81), each of which is integral with one of said spindles; and racks (82, 83) associated with each of the gear wheels and meshing therewith.

3. An apparatus according to claim 2, wherein said racks are integrally moved.

4. An apparatus according to claim 1, wherein said movement means for said head comprise sliding guides and means linearly movable along said guides.

5. An apparatus according to claim 2, wherein said movement means comprise a rotational device (50).

6. An apparatus according to claim 1, wherein said movement means comprises horizontal sliding bars (63, 64), and wherein a carriage (70) movable along said horizontal sliding bars (63, 64) is integral with said head.

7. An apparatus according to claim 6, comprising a rotational device (50) having a rotating portion (51) and a non-rotating portion, a framework (62, 61) for carrying said sliding bars (63, 64), said framework (62, 61) being integral with the rotating portion (51) of the rotational device (50), a slide (40) for carrying the non-rotating portion of the rotational device, and a second pair of horizontal sliding guides (31, 32) for slidably guiding the slide (40).

8. An apparatus according to claim 7, comprising a gear wheel (55) integral with said rotatable portion of the rotational device, and a motor driven pinion (56) for controlling said gear wheel (55).

9. An apparatus according to claim 7, comprising a frame (24), a slider (25) integral with said frame (24), and vertical sliding uprights for guiding movement of said slider (25), said second pair of sliding guides (31, 32) being carried on the frame (24).

10. An apparatus according to one of the preceding claims, wherein the movement for said carriage, slide and slider relative to said horizontal sliding bars or guides and said vertical uprights is provided by screw and nut screw control means (20, 23,41).

11. An apparatus for transferring hanks suspended from a carrier comprising:

means for defining a support structure having a vertically extending portion;

a slider device comprising a slide assembly;

guide means carried by said vertically extending portion for guiding vertical movement of said slider device;

horizontally-extending guide means carried by said slider device for guiding horizontal movement of said slide assembly;

said slide assembly having a non-rotatable portion slidably guided by said horizontally-extending guide means and a rotatable portion connected to the non-rotatable portion;

a pair of parallel rods; and means for connecting said rods to said rotatable portion so that said rods are movable between a first position in which the rods are closely spaced from each other and a second position in which the rods are spread apart from each other whereby the rods in the first position are insertable into a suspended hank and are movable into the second position to transfer the hank from the carrier to the rods.

12. An apparatus according to claim 11, wherein said means for connecting said rods to said rotatable portion comprises a rod holding head for holding the rods, and means for guiding movement of said head so that said rods are translatable with respect to said non-rotating portion.

* * * * *